US007726152B2

(12) United States Patent
Beard

(10) Patent No.: US 7,726,152 B2
(45) Date of Patent: Jun. 1, 2010

(54) MAGNETIC JEWELRY CLASP AND ARTICLE OF JEWELRY

(76) Inventor: Guy Beard, 4448 Hendricks Ave., #382, Jacksonville, FL (US) 32207

( * ) Notice: Subject to any disclaimer, the term of this patent is extended or adjusted under 35 U.S.C. 154(b) by 510 days.

(21) Appl. No.: 11/818,350

(22) Filed: Jun. 14, 2007

(65) Prior Publication Data

US 2007/0240452 A1 Oct. 18, 2007

Related U.S. Application Data

(63) Continuation-in-part of application No. 11/012,745, filed on Dec. 15, 2004, now abandoned.

(51) Int. Cl.
*A44C 5/00* (2006.01)

(52) U.S. Cl. ..... 63/3.1; 24/303; D11/3

(58) Field of Classification Search ..... None
See application file for complete search history.

(56) References Cited

U.S. PATENT DOCUMENTS

| | | | | |
|---|---|---|---|---|
| 856,480 | A | | 6/1907 | Long |
| 1,140,445 | A | | 5/1915 | Collingwood |
| 1,807,293 | A | | 5/1931 | Keller |
| 2,623,256 | A | * | 12/1952 | Feibelman ..... 24/303 |
| 3,129,477 | A | | 4/1964 | Mizuno |
| 4,901,405 | A | | 2/1990 | Grover et al. |
| 5,197,168 | A | | 3/1993 | Levy |
| 6,640,398 | B2 | | 11/2003 | Hoffman |
| 2004/0154143 | A1 | | 8/2004 | Harrell |

* cited by examiner

*Primary Examiner*—Jack W. Lavinder
(74) *Attorney, Agent, or Firm*—Thomas C. Saitta

(57) ABSTRACT

A releasable and separable magnetic clasp for a body-part encircling article of jewelry, such as a bracelet or necklace, or the article of jewelry itself comprising such clasp, the main body of the article being of semi-rigid, non-articulated construction and having an inherently curved configuration, and composed of one or more cables, braids or bundled wires or fibers. The clasp comprises a pair of ferrules joined to the main body. The ferrules are axially curved to match the inherent curve of the main body. A curved insertion member having a first magnet extends from one of the ferrules and is received by a bore present in the other ferrule, and a second magnet or magnetically receptive metal member is disposed within the bore, such that with the two ferrules joined the first magnet abuts the second magnet or metal member in order to maintain the clasp in the closed configuration.

29 Claims, 1 Drawing Sheet

MAGNETIC JEWELRY CLASP AND ARTICLE OF JEWELRY

This application is a continuation-in-part application of U.S. patent application Ser. No. 11/012,745, filed Dec. 15, 2004 now abandoned.

BACKGROUND OF THE INVENTION

This invention relates broadly to the field of clasps or similar releasable closure devices used in the field of jewelry or other body worn articles, and more particularly relates to such closure devices that are used with body encircling articles such as necklaces or bracelets. Even more particularly, the invention relates to such closure devices wherein the releasable closure mechanism involves a magnetic connection, and to the articles of jewelry comprising such closure devices.

Releasable closure devices for jewelry or similar articles are well known, and when used in connection with bracelets, necklaces or similar body- or body-part encircling articles are often referred to as clasps. The use of a releasable clasp enables the article to be easily put on and removed. Many clasps involve the use of mechanical interlocking mechanisms, such as threaded joints, pin-and-groove combinations, pivoted hooks, spring-biased catches or the like. Because of the small size of the clasps, it is often difficult to connect or release these mechanical locking mechanisms—especially when the wearer is attempting to put on or remove the jewelry without help form another person. In addition, the clasps typically detract from the aesthetics of the jewelry.

Another type of jewelry clasp utilizes one or more magnets as the releasable retention means. The use of one or more magnets allows for relatively easy operation as opposed to the sometimes difficult operation of the mechanical interlocking mechanisms. Examples of known magnetic clasps are shown in U.S. Pat. No. 2,623,256, issued in 1952 to Feibelman, U.S. Pat. No. 3,129,477, issued in 1964 to Mizuno, U.S. Pat. No. 4,901,405, issued in 1990 to Grover et al., U.S. Pat. No. 5,197,168, issued in 1993 to Levy, U.S. Pat. No. 6,640,398, issued in 2003 to Hoffman, and U.S. Patent Application Publication 2004/0154143 of Harrell. While these disclosures show magnetic clasps useable with bracelets, necklaces or like body-encircling articles of jewelry, the performance of these clasps is not optimal with regard to functionality and aesthetics due to their linear configuration in the axial direction when used with body-encircling articles of limited flexibility.

Bracelets, necklaces and the like have physical structures ranging from relatively rigid to non-structured. Relatively rigid articles may be designed as a single, shaped member, usually composed of metal or a hard plastic, with a gap of sufficient size to allow the jewelry piece to be opened a sufficient distance for passage of the neck or wrist, the article having slight flexibility to allow such action without incurring permanent deformation or bending of the article. Such articles do not require clasps for closure. Other articles of a relatively rigid nature may have multiple rigid components joined with only a single or relatively small number of joints or hinges, in which case a clasp will be required to keep the article in the closed configuration. At the opposite end of the spectrum are bracelets, necklaces and the like that are relatively non-structured or completely articulated, such as those composed of chain links or cords, and which require clasps for retention. In between are bracelets, necklaces and the like that are semi-rigid and somewhat structured, such that there is a limited amount of flexibility inherent in the article but the article retains a predetermined circular, elliptical or oval shape when worn. Examples of these articles of jewelry are those made of cables, braids or bundled fibers.

When axially linear clasps are used with semi-rigid bracelets, necklaces and the like composed of cables, braids or bundled wires or fibers formed with a predetermined circular, elliptical or oval shape, the continuity of the circular, elliptical or oval shape is broken by the linear aspect of the clasp. The nature of this type of jewelry typically requires a sleeve or ferrule to be disposed on each end of the looped article to retain the multiple ends of the cable, braid, wires or fibers. When such ferrules are axially linear, the joining of the two ferrules results in the natural curve of the jewelry being disturbed, as the curved components are suddenly directed into a linear configuration at the joint between each of the ferrules and the curved components. This can impart an undesirable bulge or misshape in the jewelry, which can be seen for example in the illustration accompanying U.S. Pat. No. 2,623,256 to Feibelman. This bulge is the result of lateral strain effects inherent in the axial curvature of the semi-rigid jewelry, and the strain at the junction between the looped article and the clasp may result in permanent deformation of the looped article or failure of the junction itself. In addition, if the clasp is of the magnetic type, the lateral strain effects act in opposition to the magnetic attraction forming the releasable connection, thereby weakening the connection such that the clasp is more likely to be accidentally opened.

The use of curved mechanical clasps is known, such as shown in U.S. Pat. No. 856,480, issued in 1907 to Long, U.S. Pat. No. 1,140,445, issued in 1915 to Collingwood, and U.S. Pat. No. 1,807,293, issued in 1929 to Keller. The Collingwood patent shows the use of a single curved sleeve in conjunction with a braided or cable bracelet, such that the natural curve of the bracelet is not altered by the joining component, but this bracelet is stretchable and the ends cannot be disconnected, since the sleeve does not function as a clasp.

It is an object of this invention to provide a magnetic clasp for body- or body-part encircling articles of jewelry composed of cables, braids or bundled wires or fibers having a semi-rigid structural configuration of circular, elliptical, oval or otherwise curved nature, wherein in the clasp is curved rather than axially linear such that the inherent curved shape of the article of jewelry is not altered, disturbed or misshaped.

SUMMARY OF THE INVENTION

The invention comprises in general a releasable and separable clasp for a body- or body-part encircling article of jewelry, such as a bracelet or necklace, or the article of jewelry itself comprising such clasp, the main body of the article being of semi-rigid construction and having an inherently curved configuration of a circular, elliptical or oval nature, the main body being composed of one or more cables, braids or bundled wires or fibers. The clasp is a magnetic clasp, such that the retention and release mechanism comprises magnetic closure means of one or two magnets that magnetically adhere to a metal component or to each other. The clasp comprises a pair of ferrules or sleeves, with one each joined in known manner to an end of the cables, braids or bundled wires or fibers. The ferrules are axially curved to match the inherent curve of the main body. A curved insertion member extends from one of the ferrules and has a magnet disposed on its end. The insertion member is sized to be received by a bore present in the other ferrule, and a second magnet or a magnetically receptive metal member is disposed within the bore, such that with the two ferrules joined the magnet disposed on the insertion member abuts the second magnet or metal member in order to retain the clasp in the closed configuration. In this manner, the axial curvature of the clasp eliminates lateral strain effects resulting from the inherent axial curvature of the main body, such that the effectiveness of the magnetic closure means joining the first ferrule and the second ferrule is increased, and further such that the main body is not deformed by lateral strain effects.

DETAILED DESCRIPTION OF THE INVENTION

Figure 1:
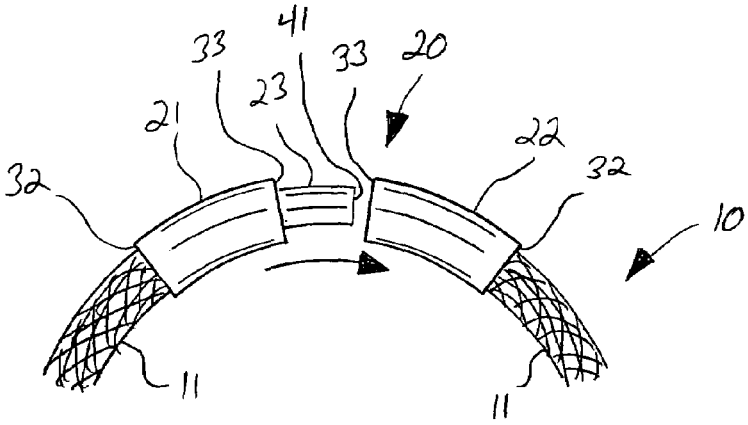
FIG. 1 is a partial view showing the clasp and main body of the invention in the released or open configuration.

With reference to the drawings, the invention will now be described in detail with regard for the best mode and the preferred embodiment. In a broad sense, the invention comprises a magnetic jewelry clasp or an article of jewelry comprising such clasp, the main body of the article of jewelry comprising one or more cables, braids, bundled wires or fibers, such that the main body has an inherent curved configuration of a semi-rigid nature.

The article of jewelry 10 is a body-encircling or body-part encircling member comprising a releasable and separable clasp 20 and a main body 11. The main body 11 is a semi-rigid, non-articulated member, wherein the rigidity is sufficient to retain a generally circular, elliptical, oval or otherwise curved configuration with only a slight flexibility, such that the main body 11 has a particular inherently curved configuration when the main body 11 is not placed under stress, tension, torsion or other force. The main body 11 is comprised of one or more cables, braids, bundled wires or bundled fibers formed of a metal or relatively rigid polymer material. The main body 11 has a pair of ends that are joined in any of the commonly known manners to the separable clasp 20 to form the article of jewelry 10.

The clasp 20 is a curved member, wherein the curvature of the clasp 20 in the axial direction matches or corresponds, i.e., substantially approximates, the axial curvature (otherwise known as the radius of curvature) of the main body 11. The clasp 20 comprises a first ferrule 21 and a second ferrule 22, each being of a sleeve-like configuration such that each ferrule 21 and 22 has a bore 31, a mounted end 32 and a mating end 33. The ends of the main body 11 are inserted into the bore 31 on the mounted ends 32 of the ferrules 21 and 22 and permanently joined to the ferrules 21 and 22 in any suitable manner, such as for example by welding, adhesive bonding, crimping, mechanical fasteners, etc. The axial curvature of each of the ferrules 21 and 22 matches or approximates the axial curvature of the main body 11 in the region adjacent the clasp 20 when no stresses are imparted on the main body 11. Most preferably, the ferrules 21 and 22 are composed of aesthetically pleasing material and the outer surfaces of the ferrules 21 and 22 may be provided with designs, ornamentation, applied objects, etc. to enhance their aesthetic appeal An insertion member 23 extends from the mating end 33 of the first ferrule 21, and the insertion member 23 is sized and configured so as to be received within the bore 31 at the mating end 31 of the second ferrule 22 in a relatively snug manner. Preferably, the insertion member 23 is a tubular or cylindrical member having an axial curvature matching or approximating that of the ferrules 21 and 22. In the embodiment shown, the insertion member 23 is permanently mounted within the bore 31 of the first ferrule 21. The insertion member 23 may be joined to the first ferrule 21 in any suitable manner, such as for example by welding, adhesive bonding, staking, crimping, etc. In an alternative embodiment, the insertion member 23 and first ferrule 21 may be formed as a single piece using known metal working or metal forming techniques.

Figure 2:
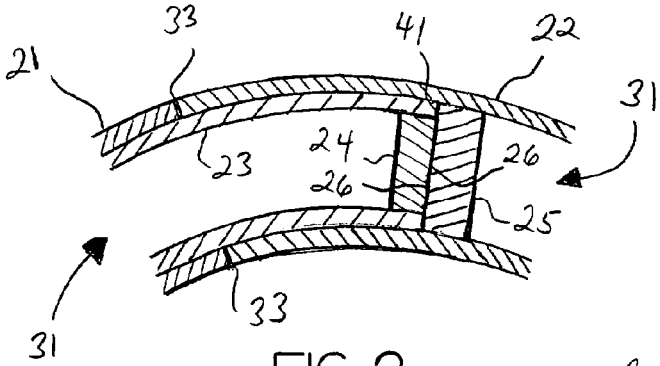
FIG. 2 is a partial cross-sectional view of the clasp of the invention in the joined or closed configuration.

Magnetic closure means are provided to releasably join the first ferrule 21 to the second ferrule 22. In the embodiment shown in FIG. 2, a first magnet 24 is disposed at the abutment end 41 of the insertion member 23. The first magnet 24 may be mounted within the insertion member 23 as shown or alternatively attached externally to the abutment end 41 of the insertion member 23, also using known techniques such as for example, welding, adhesive bonding, staking, crimping, etc. A second magnet 25 is disposed within the bore 31 of second ferrule 22, preferably at a distance from the mating end 33 such that the mating end 33 of the second ferrule 22 will abut the mating end 33 of the first ferrule when the contact faces 26 of the first and second magnets 24 and 25 are in contact after insertion of the insertion member 23 into the bore 31 of the second ferrule 22. Preferably, the magnets 24 and 25 are cylindrical in configuration with planar contact faces 26 perpendicular to the axis of curvature, but they may have polygonal or other configurations and the contact faces 26 may be curved in a convex/concave arrangement, provided that the contact faces 26 have corresponding surface structure such that a coextensive area of contact is provided for.

Figure 5:
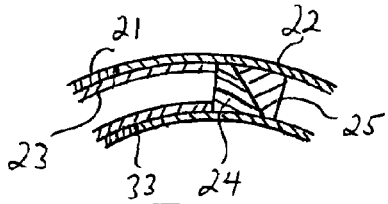
FIG. 5 is a partial cross-sectional view of an alternative embodiment of the clasp, wherein the abutting surfaces of the magnets are provided at an angle non-perpendicular to the axis in order to increase the contact surface area.
Figure 3:
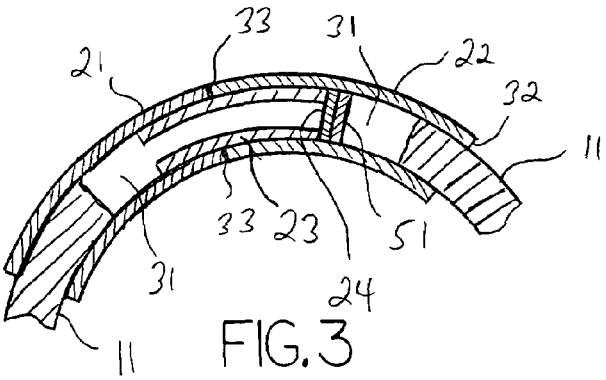
FIG. 3 is a partial cross-sectional view of an alternative embodiment of the clasp, wherein a single magnet mounted on the insertion member is used in combination with a magnetically receptive metal abutment member.
Figure 4:
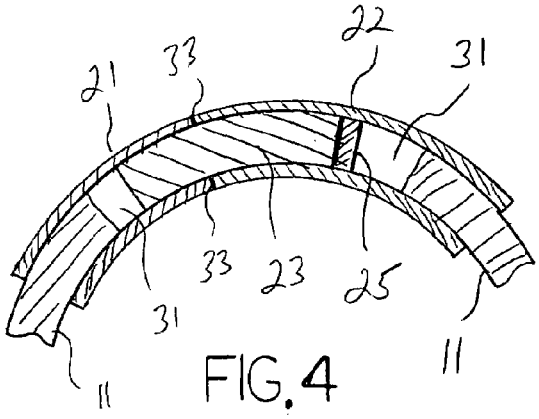
FIG. 4 is a partial cross-sectional view of an alternative embodiment of the clasp, wherein a single magnet mounted within the second ferrule is used in combination with a magnetically receptive metal abutment member.

Alternatively, the first magnet 24 may be disposed within or on the insertion member 23 and a magnetically receptive metal abutment member 51 may be disposed within the second ferrule 22 in place of the second magnet 25, as shown in FIG. 3. Likewise, a magnetically receptive metal abutment member may be substituted for the first magnet 24, or the insertion member 23 itself may be composed of a magnetically receptive metal such that it acts as the magnetically receptive metal abutment member, as shown in FIG. 4. For articles of jewelry 10 that have very thin diameters, it may be preferable to provide the magnets 24 and 25 with abutting surfaces that are non-perpendicular to the axis of curvature, such that the contact surface area is increased, as shown in FIG. 5. In these embodiments, the clasp 20 is releasably connected by the magnetic bond formed between the magnetically receptive metal abutment member and either of the magnets 24 or 25.

The structure and construction of the clasp 20 insures that the inherent axial curvature of the main body 11 is not altered when the clasp 20 is in the closed configuration. For example, if the main body 11 of the article of jewelry 10, such as a bracelet, has a two inch radius of curvature, then the clasp 20 should also have a two inch radius of curvature. For necklaces, the radius of curvature will of course be greater. When putting on the article of jewelry 10, the two ferrules 21 and 22 are easily joined, since all that is required is to align the insertion member 23 with the bore 31 of the second ferrule 22. In this manner, the axial curvature of the clasp 20 eliminates lateral strain effects resulting from the inherent axial curvature of the main body 11, such that the effectiveness of the magnetic closure means joining the first ferrule 21 and the second ferrule 22 is increased, and further such that the main body 11 is not deformed and weakened by lateral strain effects.

It is understood that equivalents or substitutions for certain elements set forth above may be obvious to those skilled in the art, and therefore the true scope and definition of the invention is to be as set forth in the following claims.

I claim:

1. A body-part encircling article of jewelry comprising a main body and a releasable and separable clasp joined to said main body;

said main body being semi-rigid, non-articulated and having an inherent axial curvature, and comprising a cable, multiple cables, a braid, multiple braids, bundled wires or bundled fibers;

said clasp having an axial curvature matching the inherent axial curvature of said main body, said clasp comprising a first ferrule, an insertion member extending from said first ferrule, a second ferrule, and a bore within said second ferrule, wherein said insertion member is received within said bore of second ferrule; and said clasp further comprising magnetic closure means whereby said first ferrule and said second ferrule are releasably joined together;

whereby said axial curvature of said clasp eliminates lateral strain effects resulting from said inherent axial curvature of said main body, such that the effectiveness of the magnetic closure means joining said first ferrule and said second ferrule is increased, and further such that said main body is not deformed by lateral strain effects.

2. The article of claim 1, wherein said magnetic closure means comprises a magnet attached to said insertion member.

3. The article of claim 2, wherein said magnetic closure means further comprises a magnet disposed within said bore of said second ferrule.

4. The article of claim 2, wherein said magnet is disposed within said insertion member.

5. The article of claim 2, further comprising a magnetically receptive abutment member disposed within said second ferrule.

6. The article of claim 5, wherein said first ferrule and said second ferrule have mating ends, whereby said mating ends of said first and said second ferrules abut when said magnet attached to said insertion member contacts said magnetically receptive abutment member disposed within said bore of said second ferrule.

7. The article of claim 1, wherein said magnetic closure means comprises a magnet disposed within said bore of said second ferrule.

8. The article of claim 7, further comprising a magnetically receptive abutment member disposed on said insertion member.

9. The article of claim 8, wherein said first ferrule and said second ferrule have mating ends, whereby said mating ends of said first and said second ferrules abut when said magnet disposed within said bore of said second ferrule contacts said magnetically receptive abutment member disposed on said insertion member.

10. The article of claim 7, wherein said insertion member is composed of a magnetically receptive abutment member.

11. The article of claim 10, wherein said first ferrule and said second ferrule have mating ends, whereby said mating ends of said first and said second ferrules abut when said magnet disposed within said bore of said second ferrule contacts said insertion member.

12. The article of claim 1, wherein said insertion member has an axial curvature matching the inherent axial curvature of said main body.

13. The article of claim 1, wherein said first ferrule, said second ferrule and said insertion member are curved tubular members.

14. The article of claim 1, wherein said magnetic closure means comprises a magnet attached to said insertion member and a magnet disposed within said bore of said second ferrule, and further wherein said first ferrule and said second ferrule have mating ends, whereby said mating ends of said first and said second ferrules abut when said magnet attached to said insertion member contacts said magnet disposed within said bore of said second ferrule.

15. A releasable and separable clasp for a body-part encircling article of jewelry comprising a semi-rigid, non-articulated, main body having an inherent axial curvature, and comprising a cable, multiple cables, a braid, multiple braids, bundled wires or bundled fibers;

said clasp having an axial curvature matching the inherent axial curvature of said main body, said clasp comprising a first ferrule, an insertion member extending from said first ferrule, a second ferrule, and a bore within said second ferrule, wherein said insertion member is received within said bore of second ferrule; and said clasp further comprising magnetic closure means whereby said first ferrule and said second ferrule are releasably joined together;

whereby said axial curvature of said clasp eliminates lateral strain effects resulting from said inherent axial curvature of said main body, such that the effectiveness of the magnetic closure means joining said first ferrule and said second ferrule is increased, and further such that said main body is not deformed by lateral strain effects.

16. The clasp of claim 15, wherein said magnetic closure means comprises a magnet attached to said insertion member.

17. The clasp of claim 16, wherein said magnetic closure means further comprises a magnet disposed within said bore of said second ferrule.

18. The clasp of claim 16, wherein said magnet is disposed within said insertion member.

19. The clasp of claim 16, further comprising a magnetically receptive abutment member disposed within said second ferrule.

20. The clasp of claim 19, wherein said first ferrule and said second ferrule have mating ends, whereby said mating ends of said first and said second ferrules abut when said magnet attached to said insertion member contacts said magnetically receptive abutment member disposed within said bore of said second ferrule.

21. The clasp of claim 15, wherein said magnetic closure means comprises a magnet disposed within said bore of said second ferrule.

22. The clasp of claim 21, further comprising a magnetically receptive abutment member disposed on said insertion member.

23. The clasp of claim 22, wherein said first ferrule and said second ferrule have mating ends, whereby said mating ends of said first and said second ferrules abut when said magnet disposed within said bore of said second ferrule contacts said magnetically receptive abutment member disposed on said insertion member.

24. The clasp of claim 21, wherein said insertion member is composed of a magnetically receptive abutment member.

25. The clasp of claim 24, wherein said first ferrule and said second ferrule have mating ends, whereby said mating ends of said first and said second ferrules abut when said magnet disposed within said bore of said second ferrule contacts said insertion member.

26. The clasp of claim 15, wherein said insertion member has an axial curvature matching the inherent axial curvature of said main body.

27. The clasp of claim 15, wherein said first ferrule, said second ferrule and said insertion member are curved tubular members.

28. The clasp of claim 15, wherein said magnetic closure means comprises a magnet attached to said insertion member and a magnet disposed within said bore of said second ferrule, and further wherein said first ferrule and said second ferrule have mating ends, whereby said mating ends of said first and said second ferrules abut when said magnet attached to said insertion member contacts said magnet disposed within said bore of said second ferrule.

29. The clasp of claim 15, wherein said magnetic closure means have abutting surfaces non-perpendicular to said axial curvature.

* * * * *